US007369801B2

(12) United States Patent
Tsueda et al.

(10) Patent No.: US 7,369,801 B2
(45) Date of Patent: May 6, 2008

(54) IMAGE FORMING APPARATUS AND FIXING APPARATUS

(75) Inventors: Yoshinori Tsueda, Fuji (JP); Satoshi Kinouchi, Tokyo (JP); Osamu Takagi, Chofu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 84 days.

(21) Appl. No.: 11/080,833

(22) Filed: Mar. 16, 2005

(65) Prior Publication Data

US 2006/0210329 A1 Sep. 21, 2006

(51) Int. Cl.
*G03G 15/20* (2006.01)
*G03G 15/16* (2006.01)

(52) U.S. Cl. ..... 399/328; 399/33; 399/122

(58) Field of Classification Search ..... 399/328, 399/33, 122, 333
See application file for complete search history.

(56) References Cited

U.S. PATENT DOCUMENTS 5,915,147 A * 6/1999 Kouno et al. ..... 399/69
6,026,273 A 2/2000 Kinouchi et al.
6,078,781 A 6/2000 Takagi et al.
6,087,641 A 7/2000 Kinouchi et al.
6,097,926 A 8/2000 Takagi et al.
6,137,985 A 10/2000 Kinouchi et al.
6,154,629 A 11/2000 Kinouchi et al.
6,337,969 B1 1/2002 Takagi et al.
6,381,423 B1 * 4/2002 Eom ..... 399/45
6,415,128 B1 7/2002 Takagi et al.
6,438,335 B1 8/2002 Kinouchi et al.
6,643,476 B1 11/2003 Kinouchi et al.
6,643,491 B2 11/2003 Kinouchi et al.
6,724,999 B2 4/2004 Kikuchi et al.
6,725,000 B2 4/2004 Takagi et al.
6,763,206 B2 7/2004 Kinouchi et al.
6,861,627 B2 3/2005 Wasai et al.
6,861,630 B2 3/2005 Kinouchi et al.
6,868,249 B2 3/2005 Kinouchi et al.
6,871,041 B2 3/2005 Takagi et al.

(Continued)

FOREIGN PATENT DOCUMENTS

JP 6-324596 A 11/1994

(Continued)

OTHER PUBLICATIONS

U.S. Appl. No. 11/078,421, filed Mar. 14, 2005, Takagi et al.

(Continued)

*Primary Examiner*—David M. Gray
*Assistant Examiner*—Joseph S. Wong
(74) *Attorney, Agent, or Firm*—Foley & Lardner LLP

(57) ABSTRACT

An image forming apparatus according to the present invention includes a heating roller 2 fixed at a predetermined position, a pressurizing roller 3 press-fitted to the heating roller 2 by a pressurizing mechanism 4 to be movable, and a hardness change detecting mechanism 310 which becomes electrically conductive when the pressurizing roller 3 moves due to thermal expansion of the heating roller 2, and which detects a hardness change of the heating roller 2.

4 Claims, 8 Drawing Sheets

U.S. PATENT DOCUMENTS

| | | | | |
|---|---|---|---|---|
| 6,889,018 | B2 | 5/2005 | Kinouchi et al. | |
| 6,898,409 | B2 | 5/2005 | Tsueda et al. | |
| 6,900,419 | B2 | 5/2005 | Takagi et al. | |
| 2002/0114650 | A1* | 8/2002 | May et al. | 399/302 |
| 2003/0113143 | A1* | 6/2003 | Maeda et al. | 399/328 |
| 2004/0175212 | A1* | 9/2004 | Tsueda et al. | 399/333 |
| 2004/0238531 | A1 | 12/2004 | Kikuchi et al. | |
| 2004/0265021 | A1 | 12/2004 | Kinouchi et al. | |
| 2005/0008413 | A1 | 1/2005 | Takagi et al. | |
| 2005/0031363 | A1* | 2/2005 | Nishi | 399/69 |

FOREIGN PATENT DOCUMENTS

| | | | |
|---|---|---|---|
| JP | 2000-181263 | A | 6/2000 |

OTHER PUBLICATIONS

U.S. Appl. No. 11/078,725, filed Mar. 14, 2005, Takagi et al.
U.S. Appl. No. 11/078,726, filed Mar. 14, 2005, Tsueda et al.
U.S. Appl. No. 11/082,218, filed Mar. 17, 2005, Tsueda et al.
U.S. Appl. No. 10/820,138, filed Apr. 8, 2004, Sone et al.
U.S. Appl. No. 10/805,514, filed Mar. 22, 2004, Kinouchi et al.
U.S. Appl. No. 10/805,305, filed Mar. 22, 2004, Sone et al.
U.S. Appl. No. 10/805,420, filed Mar. 22, 2004, Sone et al.
U.S. Appl. No. 10/799,770, filed Mar. 15, 2004, Kikuchi et al.
U.S. Appl. No. 10/805,507, filed Mar. 22, 2004, Kikuchi et al.
U.S. Appl. No. 10/805,522, filed Mar. 22, 2004, Kikuchi et al.
U.S. Appl. No. 10/806,392, filed Mar. 23, 2004, Takagi et al.
U.S. Appl. No. 10/805,308, filed Mar. 22, 2004, Tsueda et al.
U.S. Appl. No. 10/378,859, filed Mar. 5, 2003, Sone et al.
U.S. Appl. No. 10/945,395, filed Sep. 21, 2004, Kinouchi et al.
U.S. Appl. No. 10/944,855, filed Sep. 21, 2004, Sone et al.
U.S. Appl. No. 10/944,707, filed Sep. 21, 2004, Sone et al.

* cited by examiner

IMAGE FORMING APPARATUS AND FIXING APPARATUS

FIELD OF THE INVENTION

The present invention relates to a fixing apparatus for fixing a developer image on paper and an image forming apparatus having the fixing apparatus mounted thereon.

BACKGROUND OF THE INVENTION

An image forming apparatus utilizing a digital technology, for example, an electronic copying machine, has a fixing apparatus for fixing a developer image molten by heating onto paper by applying a pressure to the image.

Such a fixing apparatus comprises: a heating member for melting a developer, for example, a toner, and a pressurizing member for applying a pressure to the heating member, wherein a predetermined contact width (nip width) is formed in a contact region (nip portion) between the heating member and the pressurizing member. The developer on the paper passing through the nip portion is molten by a heat from the heating member, the molten developer is pressurized by the pressurizing member to be fixed onto the paper. In recent years, a heating device utilizing inductive heating has been utilized in this fixing apparatus. For example, there is known a heating device for generating a magnetic field from a coil, and then, supplying an eddy current to a thin film conductive layer formed outside of the heating member, thereby generating a heat.

The heating member includes a roller shaped elastic member inside of the conductive layer in order to ensure a predetermined or greater nip width between the heating member and the pressurizing member. The elastic member is composed of, for example, a foam rubber or the like, and includes a large amount of air. Thus, the elastic member has a large thermal expansion coefficient. On the other hand, the conductive layer including a metal or the like has a thermal expansion coefficient which is smaller than that of the elastic member. Thus, the expanded elastic member pushes the conductive layer from the inside, and the hardness of the heating member becomes high. Therefore, there is a problem that a predetermined or greater nip width cannot be allocated.

BRIEF SUMMARY OF THE INVENTION

According to an aspect of the present invention, there is provided an image forming apparatus comprising:

an image carrier which holds a developer image in an electrostatic manner; and a fixing apparatus which melts and fixes the developer image onto a recording medium to which the developing material image has been transferred, the fixing apparatus comprising:

a first roller member fixed at a predetermined position and rotated by a drive mechanism;

a second roller member having a shaft member, the second roller member being press-fitted against the first roller member by a pressure applying mechanism via a bearing member connected to the shaft member;

an elastic layer formed at least at one of the first roller member and the second roller member;

an conductive layer formed outside of the elastic layer;

an inductive heating device including a coil, the inductive heating device supplying inductive heating to the conductive layer by a magnetic field generated from the coil, thereby heating the conductive layer; and a hardness change detecting mechanism which detects expansion of an outer periphery face of the first roller member or the second roller member due to thermal expansion caused by the inductive heating, thereby detecting a hardness change of the first roller member or the second roller member.

According to another aspect of the present invention, there is provided a fixing apparatus comprising:

a first roller member fixed at a predetermined position and rotated by a drive mechanism;

a second roller member having a shaft member, the second roller member being press-fitted against the first roller member by a pressure applying mechanism via a bearing member connected to the shaft member;

an elastic layer formed at least at one of the first roller member and the second roller member;

an conductive layer formed outside of the elastic layer;

an inductive heating device including a coil, the inductive heating device supplying inductive heating to the conductive layer by a magnetic field generated from the coil, thereby heating the conductive layer; and a hardness change detecting mechanism which detects expansion of an outer periphery face of the first roller member or the second roller member due to thermal expansion caused by the inductive heating, thereby detecting a hardness change of the first roller member or the second roller member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, preferred embodiments of the present invention will be described with reference to the accompanying drawings.

Figure 1:
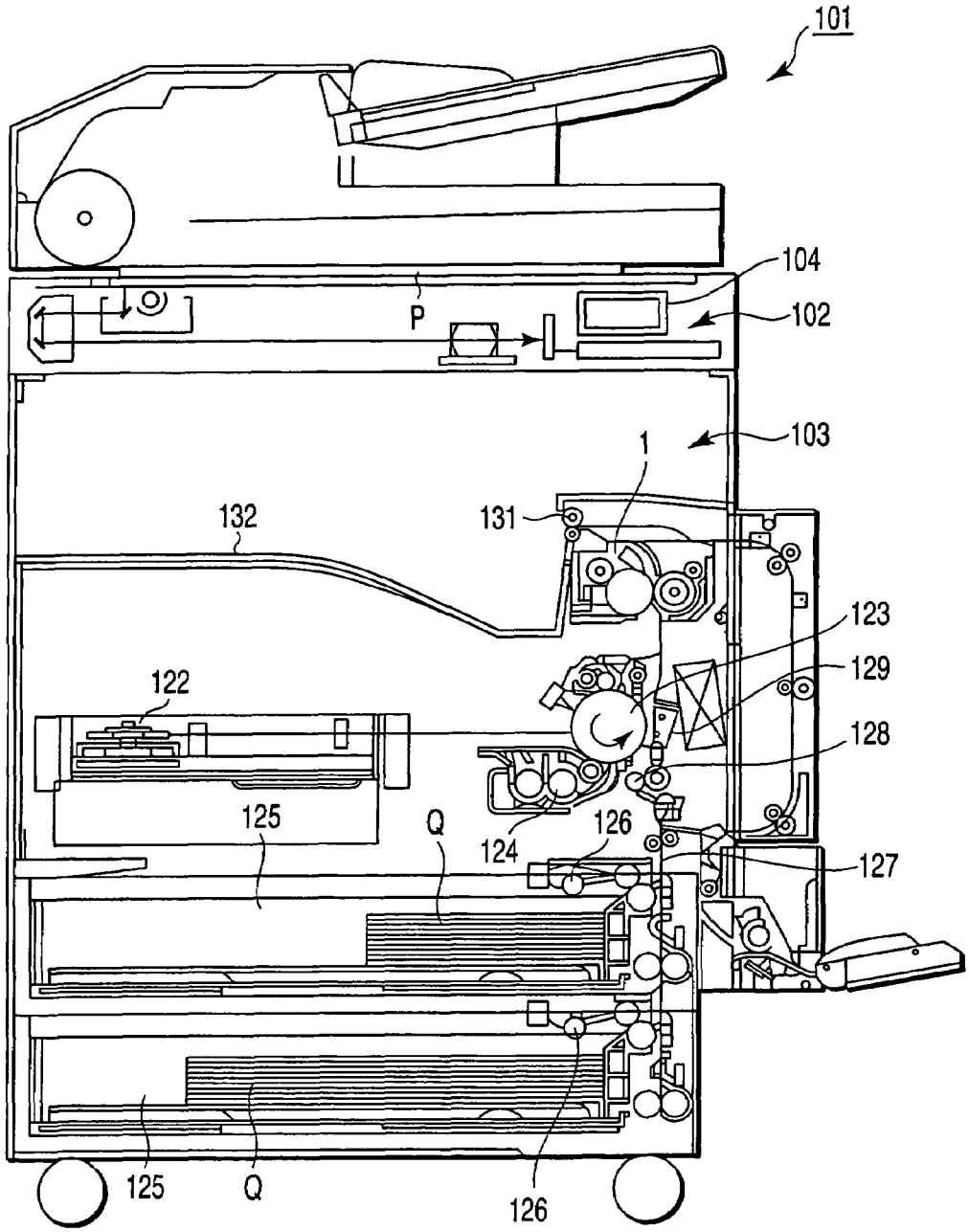
FIG. 1 is a schematic view showing an example of an image forming apparatus according to the present invention.

As shown in FIG. 1, an image forming apparatus (digital copying apparatus) 101 has: an image reader device (scanner) 102 which reads an image of a copying object (document) P to generate an image signal; an image forming section 103 which forms an image based on the image signal outputted from the scanner 102; and a display section 104 which is provided outside of the image forming apparatus 101 and which displays a message from a control mechanism for controlling at least one of the scanner 102 and the image forming section 103.

The image forming section 103 comprises a fixing apparatus 1, a power charger device 121, an exposure device 122, a photosensitive drum 123, a developing device 124, a sheet cassette 125, a pickup roller 126, a transport passage 127, an aligning roller 128, a transfer device 129, a paper ejecting roller 131, and a tray 132.

When image reading or image forming of the document P is instructed, the scanner 102 outputs an image signal based on the document P to the image forming section 103. The exposure device 121 emits a laser beam based on the image signal to the photosensitive drum 123 to which a predetermined electrical charge has been supplied by the power charger device 122. In this manner, an electrostatic image formed on a surface of the photosensitive drum 123 is converted into a toner image by the developing device 124.

On the other hand, paper Q housed in the sheet cassette 125 is taken out by the pickup roller 126 on a one by one sheet basis, and the paper Q is guided to the transport passage 127 toward the photosensitive drum 123. The paper Q guided to the transport passage 127 is temporarily stopped for the purpose of alignment with a toner image (not shown) on the photosensitive drum 123 to be transferred by means of the aligning roller 128, and then, the paper Q is transported to the photosensitive drum 123 at a predetermined timing.

The paper Q to which the toner image on the photosensitive drum 123 has been transferred is guided to the fixing apparatus 1 by the transfer device 129. The fixing apparatus 1 applies a heat and a pressure to the paper Q which holds a developer image, and then, melts and fixes the molten developer image to the paper Q. In this manner, an image of the document P is formed on the paper Q. The image-formed paper Q is ejected to the tray 132 by the paper ejecting roller 131.

First Embodiment

Figure 2:
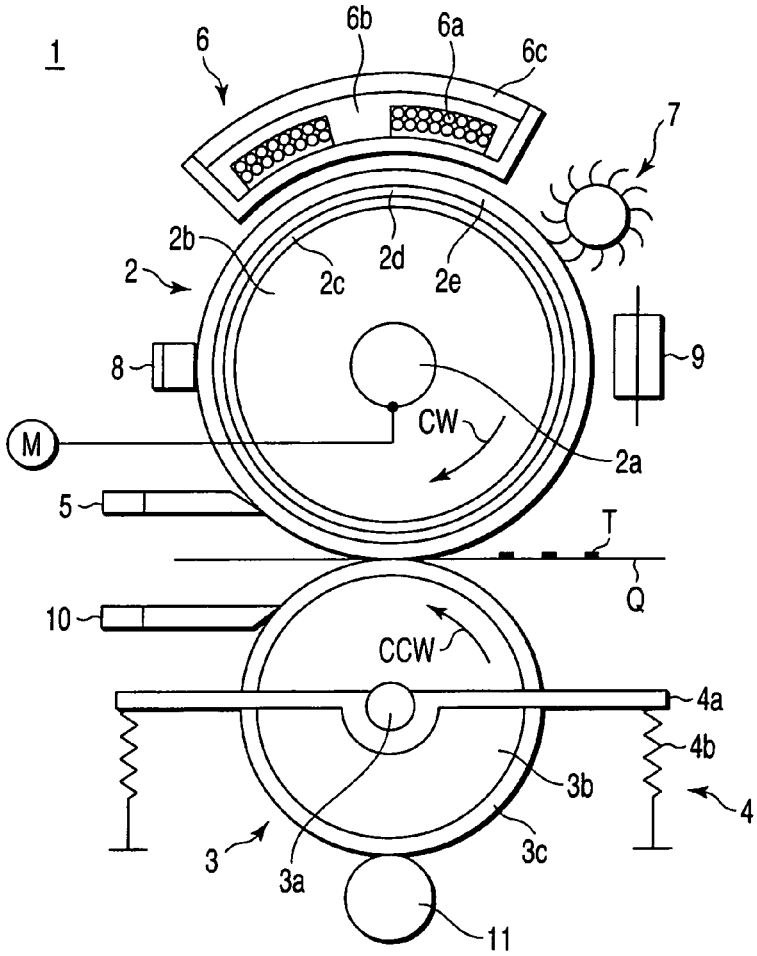
FIG. 2 is a schematic view showing an example of a fixing apparatus to be mounted on the image forming apparatus shown in FIG. 1.
Figure 3:
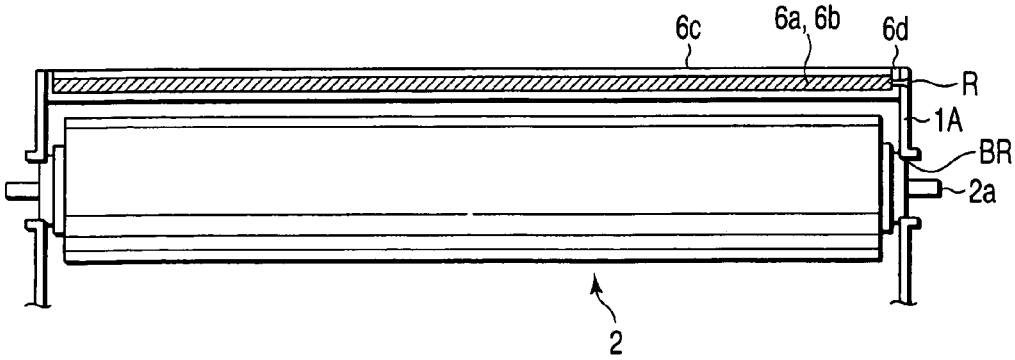
FIG. 3 is a fragmental view showing a part of the fixing apparatus shown in FIG. 2.
Figure 4:
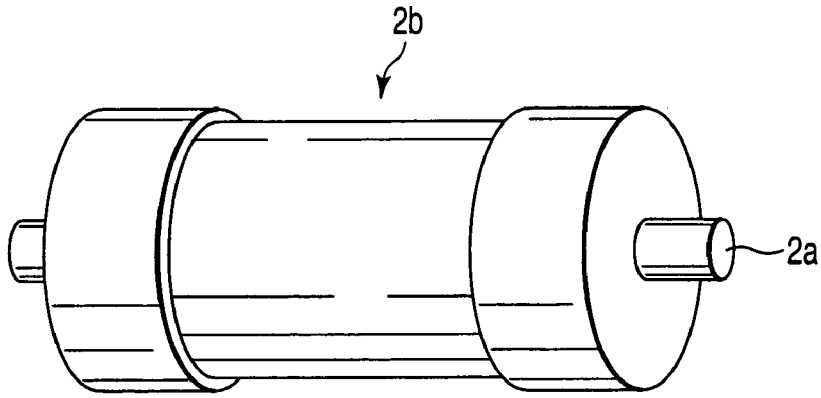
FIG. 4 is a schematic view showing an example of an elastic member available for use in the fixing apparatus shown in FIG. 2.

FIG. 2 shows an example of the fixing apparatus 1 shown in FIG. 1. FIG. 3 is a fragmental view showing a part of the fixing apparatus 1 shown in FIG. 2. FIG. 4 is a schematic view showing an elastic member included in the fixing apparatus shown in FIG. 2.

As shown in FIG. 2, the fixing apparatus 1 can come into contact with a face onto which a toner T of a material targeted for transfer, i.e., paper Q adheres. This fixing apparatus has: a heating member (heating roller) 2 which heats the toner T and the paper Q; a pressurizing member (pressurizing roller) 3 which applies a predetermined pressure to the heating roller 1; and a pressurizing mechanism 4 which applies a predetermined pressure to the pressurizing roller 3; and an inductive heating device 6 which heats the heating roller 2 by utilizing inductive heating.

The heating roller 2 has: a shaft member 2*a*; an elastic member 2*b* positioned at the periphery of the shaft member; a conductive layer 2*c*; a primer layer 2*d*; and a molding release layer 2*e*. The elastic member 2*b* may be provided between the conductive layer 2*c* and the molding release layer 2*e*.

The shaft member 2*a*, as shown in FIG. 3, is fixed to the fixing apparatus 1 via a bearing BR provided on a frame 1A fixed to a main body of the fixing apparatus 1.

In the elastic member 2*b*, as shown in FIG. 4, an outer diameter of a center portion thereof in an axial direction has a smaller shape as compared with an outer diameter of an end portion thereof.

The pressurizing roller 3 includes: a shaft member 3*a*; an elastic member (for example, silicon rubber) 3*b* allocated outside of the shaft member; and a molding release layer (for example, fluorine rubber) 3*c*.

The pressurizing mechanism (pressure applying mechanism) 4 presses the pressurizing roller 3 against the heating roller 2 by an expansion and contraction force of a pressurizing spring 4*b* via a bearing member 4*a* connected to the shaft member 3*a*.

In this manner, a nip portion having a fixed width (not width) is formed at a contact portion between the heating roller 2 and the pressurizing roller 3 in a transport direction of the paper Q. The heating roller 2 is rotated in a clockwise (CW) direction indicated by the arrow by means of a drive motor M. With rotation of the heating roller 2, the pressurizing roller 3 is rotated in a counterclockwise (CCW) direction indicated by the arrow.

A releasing blade 5 and a cleaning member 7 are provided at the periphery of the heating roller 2. The releasing blade 5 is allocated at the downstream side of the nip portion between the heating roller 2 and the pressurizing roller 3 in the transport direction of the paper Q to release the paper Q from the heating roller 1. The cleaning member 7 removes dust such as offset toners or paper chips which adhere to the heating roller 2.

Further, in a longitudinal direction of the heating roller 2, there are allocated: a thermister (temperature detecting section) 8 which detects a temperature of the heating roller 2, and a thermostat 9 which stops supply of power for heating the heating roller 2 by sensing a failure of a surface temperature of the heating roller 2. It is preferable that a plurality of thermisters 8 are provided in the longitudinal direction of the heating roller 2, and that at least one or more thermostats 9 are provided in the longitudinal direction of the heating roller 2.

At the periphery of the pressurizing roller 3, there are allocated: a releasing blade 10 for releasing the paper Q from the pressurizing roller 3, and a cleaning member 11 for removing the toner adhering to the pressurizing roller 3.

The inductive heating device 6 includes: a coil 6*a*; a core 6*b* allocated at the rear side of the coil 6*a* (on the coil face side which is distant from the heating roller 2); a heat resistance resin member 6*c* allocated at the further outside, the resin member covering the coil and core; and a heating device frame 6*d* which supports the coil 6*a*, core 6*b*, and heat resistance resin member 6*c*. In addition, as shown in FIG. 3, the heating device frame 6*d* is fixed to the frame 1A of the fixing apparatus 1 via a fixing member R (such as a screw nut, an adhesive, and an engagement hole). That is, the coil 6*a* is fixed at a predetermined position of the fixing apparatus 1. As described above, the shaft member 2*a* is also fixed to the fixing device frame 1A. Thus, a distance between the shaft member 2*a* and the coil 6*a* is constant and kept unchanged.

As described later with reference to FIG. 5, the coil 6*a* is controlled by a CPU 28 or the like which integrally controls an operation of the fixing apparatus 1, and a predetermined high frequency current is supplied to thereby generate a predetermined magnetic field. By this magnetic field, an eddy current flows the conductive layer 2*c* against the heating roller 2, a Joule heat is generated according to a resistance value of the conductive layer 2*c*, and the heating roller 2 generates a heat.

Therefore, the paper Q holding the toner T passes through the nip portion formed between the heating roller 2 and the pressurizing roller 3, the toner is thereby molten, and the molten toner is press-fitted onto the paper Q to fix an image.

As described above, the elastic member 2*b* is formed in a shape having a different outer diameter in an axial direction, as shown in FIG. 4, whereby the air inside of the thermally expanded heating roller 2 can be excavated to a gap portion between the elastic member 2*b* and the conductive layer 2*c*. This leads to improvement of a problem that the hardness of the heating member 2 becomes too high due to a difference in thermal expansion coefficient between the elastic member 2*b* and the conductive layer 2*c* described above.

Figure 5:
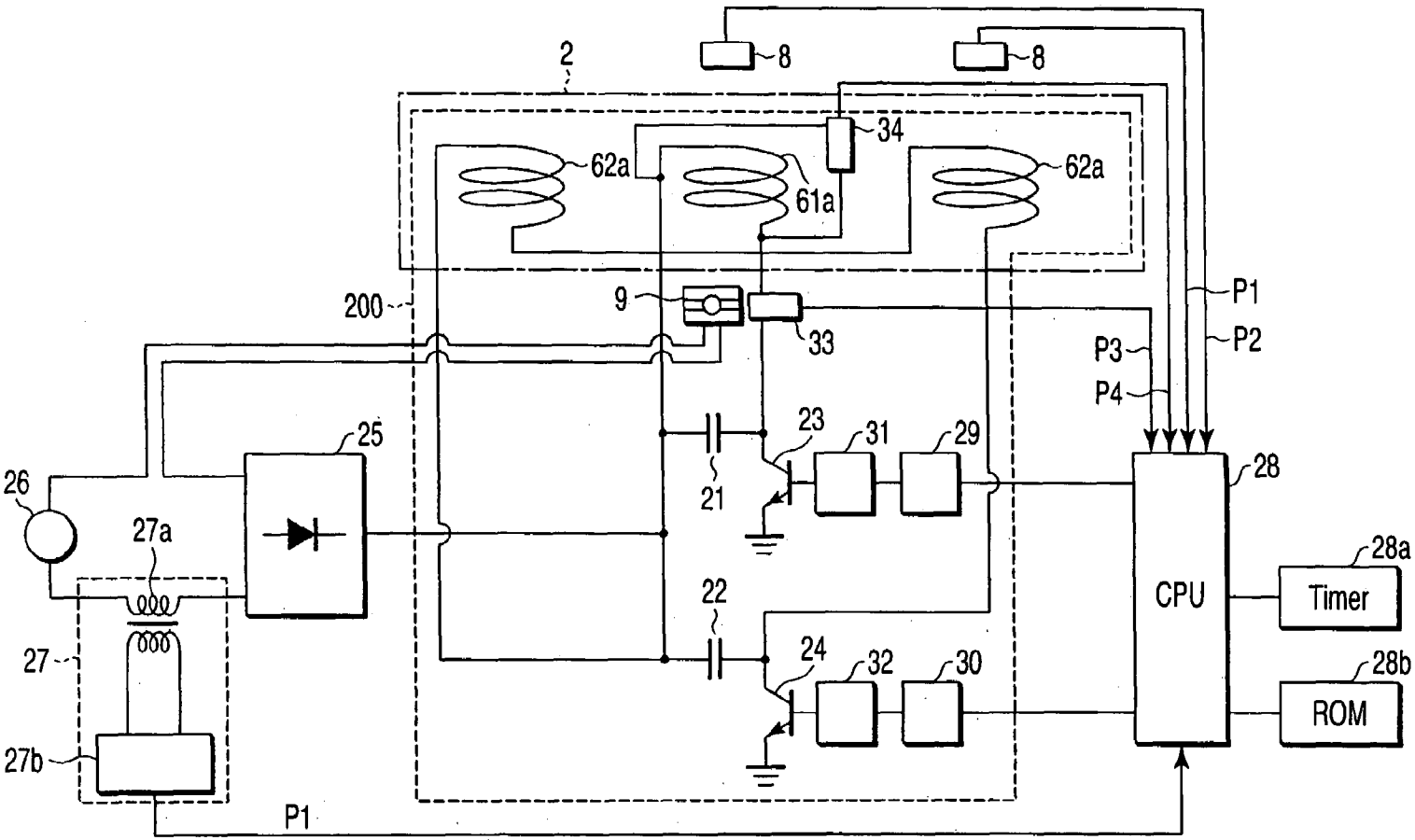
FIG. 5 is a block diagram depicting a control system of the fixing apparatus shown in FIGS. 1 and 2.

Referring now to FIG. 5, a description will be given with respect to a configuration of a control section which controls the fixing apparatus 1 shown in FIGS. 1 and 2 and an example of a method of controlling inductive heating. In the present embodiment, the coil 6*a* shown in FIG. 2 includes a center coil 61*a* allocated to be opposed to the center portion in the longitudinal direction of the heating roller 1, and end portion coils 62*a* allocated at both ends of this center coil, as shown in FIG. 5.

The control section shown in FIG. 5 has an inductive heating controller circuit (IH controller circuit) 200, a rectifier circuit 25, a commercially alternating current power supply 26, an input power monitor 27, and the CPU 28 which integrally controls the fixing apparatus 1.

The IH controller circuit 200 includes a first inverter circuit which includes the center coil 61*a*, and a second inverter circuit which includes the end portion coils 62*a*.

The first inverter circuit includes: a first resonator circuit which includes the center coil 61 and a resonating capacitor 21 connected in parallel to each other; and a switching element 23 connected in series to the first resonating inverter circuit. The second inverter circuit includes: a second resonator circuit which includes the end portion coils 62*a* and a resonating capacitor 22 connected in parallel to each other; and a switching element 24 connected in series to the second resonator circuit.

The coil 61*a* is connected to each of a current sensing section 33 which senses a current value flowing the coil 61*a* and a voltage sensing section 34 which senses a voltage value supplied to the coil 61*a*.

A direct current is supplied from the commercially available alternating current power supply 26 smoothened by the rectifier circuit 25 to the first and second inverter circuits. The thermostat 9 and the input power monitor 27 are connected between the rectifier circuit 25 and the commercially available current power supply 26. The input power monitor 27 monitors input power P1 which is a product of the current and voltage applied from the commercially available alternating current power supply 26.

The thermostat 9 shuts down a current from the commercially available alternating current power supply 26 supplied to the coils 61*a*, 62*a* in the case where the surface temperature of the heating roller 2 has reached an abnormal temperature.

The input power monitor 27 includes: a transformer 27*a* connected to the commercially available alternating current power supply 26; and an input power detector circuit 27*b* which detects the input power P1 transmitted from the transformer 27*a*.

The CPU 28 is connected to the input power detector circuit 27*a*, a timer 28*a*, a ROM 28*b*, a controller circuit 29, a controller circuit 30, the thermister 8, the current sensing section 33, and the voltage sensing section 34. Input power information P1 from the input power detector circuit 27*a*, temperature information P2 from the thermister 8, a current value P3 from the current sensing section 33, and a voltage value P4 from the voltage sensing section 34 are inputted in the CPU 28.

The CPU 28 makes control so as to heat the conductive layer 2*c* on the basis of these input signals and maintain the surface temperature of the heating roller 2 at a set temperature.

Figure 6:
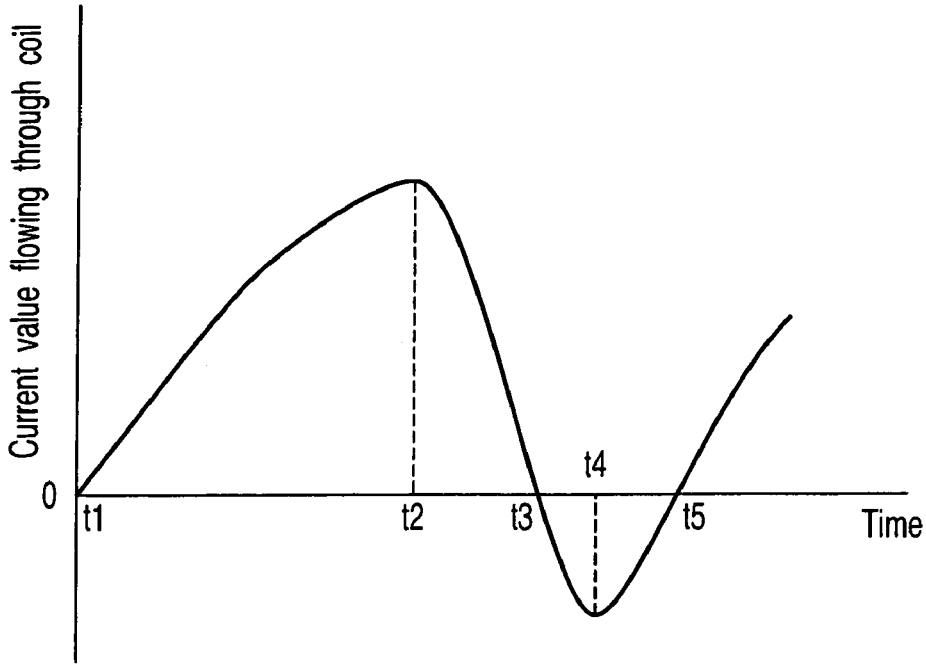
FIG. 6 is a reference view showing a relationship between a current value (vertical axis) and a time (horizontal axis), the current flowing through a coil of an inverter circuit shown in FIG. 5.

Referring now to FIG. 6, a description will be given with respect to an example of a method of controlling inductive heating of the heating roller 2 by means of the CPU 28. FIG. 6 shows a relationship between a time (horizontal axis) and a current value flowing through the coil 61*a* (vertical axis).

For example, in the case where only the center portion of the heating roller 2 is heated (that is, in the case where a high frequency current is supplied to the coil 61*a*), the CPU 28 instructs the driver circuit 31 to be driven at a predetermined drive frequency. In this manner, the switching element 23 is turned ON/OFF at a predetermined timing, and then, a high frequency current flows through the coil 61*a*.

A description will be given in detail with reference to FIG. 6. The switching element 23 is turned ON, and a current flows through the coil 61*a*. At the same time, the CPU 28 starts measurement by means of the timer 28*a*. At this time, the current flowing through the coil 61*a*, as shown in FIG. 6, increases gradually with an elapse of time (t1 to t2). A time (t1 to t2) during which the switching element is turned ON is hereinafter referred to as an ON time.

The CPU 28 determines whether or not predetermined power W61 has been supplied to the coil 61*a* on the basis of the input power information P1 inputted from the input power detector circuit 27*a*, the current value P3 inputted from the current sensing section 33, or the voltage value P4 inputted from the voltage sensing section 34. When the predetermined power W61 is supplied to the coil 61*a*, the CPU 28 instructs the controller circuit 29 to turn OFF the switching element 23. At the same time, the CPU 28 stops measurement by the timer 28*a*, and stores in the ROM 28*a* the ON time T1 (t1 to t2) of the switching element 23 measured by the timer 28*a*.

When the switching element 23 is turned OFF, the current flowing through the coil 61*a* flows into the capacitor 21, and the capacitor 21 is charged (t2 to t3). Thereafter, the charged capacitor 21 starts power discharging, and a current in an opposite direction flows through the coil 61*a* (t3 to t4). The current flowing through the coil 61*a* cannot stop even if a voltage of the capacitor 21 becomes zero, and flows inside of the switching element 23 (t4 to t5). Then, the CPU 28 turns ON the switching element 23 again when the current flowing through the coil 61*a* becomes zero. Due to repetition of the ON/OFF control, a high frequency current is supplied to the coil 61*a*.

When a high frequency current is thus supplied to the coil 61*a*, a predetermined magnetic field is generated from the coil 61*a*. An eddy current flows through the conductive layer 2*c* subjected to the magnetic field from the coil 61*a*. In this way, the conductive layer 2*c* generates a heat by inductive heating, and the surface temperature of the heating roller 2 increases. The thermister 8 detects the surface temperature of the heating roller 2 and outputs the temperature information P2 to the CPU 28. The CPU 28 then instructs the controller circuit 29 to set a proper drive frequency such that the surface temperature of the heating roller 2 becomes a set temperature suitable to melting and fixation of the toner T on the basis of the temperature information P2 and other input information P1, P3 and P4. Such feedback control makes it possible to maintain the surface temperature of the heating roller 2 at a set temperature.

The CPU 28 also compares the ON time T1 measured by the timer 28*a* with a predetermined ON time T2 of the switching element 23 which is predetermined according to the drive frequency instructed to the drive circuit 31, making it possible to sense that electrical characteristics of the coil 61*a* have changed. That is, due to a change in electrical characteristics of the coil 61*a*, it is determined that a distance between the conductive layer 2*c* and the coil 61*a* has changed. In this manner, it is determined that an outer periphery face of the heating roller 2 has expanded due to thermal expansion (in other words, it is determined that an outer diameter of the heating roller 2 has increased). That is, it is determined that the surface hardness of the heating roller 2 has changed.

The CPU 28 having detected a change in surface hardness of the heating roller 2 outputs at least a signal for stopping an operation of the IH controller circuit 200 which heats the heating roller 2. In the embodiment, operations of the fixing apparatus 1 and the image forming apparatus 101 are stopped, and equipment stoppage (error) is displayed at the display section 104.

Therefore, the hardness of the heating roller 2 is prevented from being excessively higher. Thus, the hardness of the heating roller 2 is maintained at a predetermined or lower level, so that the heating roller 2 and the pressurizing roller 3 can ensure a predetermined range of nip width. Accordingly, good image fixing can be carried out.

As described above, the control section described with reference to FIG. 5 in the embodiment includes a hardness change detecting mechanism capable of sensing a change in electrical characteristics of the coil 61*a* or the coil 62*a* based on the ON time T1 measured by the timer 28*a*, and detecting that the hardness of the heating roller 2 has changed due to thermal expansion.

Namely, the hardness change detecting mechanism detects a hardness change of the heating roller 2 by utilizing a change in electrical characteristics of the coil 61*a*.

This is understood by a principle shown below.

As described above, the CPU 28 determines that the predetermined power W61 has been supplied to the coil 61*a* on the basis of the input power information P1, the current value P3, the voltage value P4 and the like which are inputted therein, and turns OFF the switching element 23. Therefore, the power W61 supplied at a predetermined time also changes due to a change in electrical characteristics of the coil 61*a* (herein referred to as change in resistance value), and thus, an increment of the current value shown in FIG. 6 also changes. Accordingly, a time required for the power W61 to be supplied according to the resistance value of the coil 61*a* (i.e., ON time) also changes.

Thus, in the case where an allowable or more difference occurs as a result of comparison between the ON time T1 measured by the timer 28*a* and the predetermine ON time T2, it is possible to determine that the resistance values of the coils 61*a*, 62*a* utilized for inductive heating have changed.

In this way, by sensing that the electrical characteristics of the coil 61*a* have changed, it is sensed that the distance between the coil 61*a* and the conductive layer 2*c* has changed. Namely, the CPU 28 can determine that the outer diameter of the heating roller 2 increases due to thermal expansion and that the conductive layer 2*c* becomes more proximal to the coil 6*a*.

Consequently, in the case where an allowable or more difference occurs as a result of comparison between the ON time T1 measured by the timer 28*a* and the predetermined ON time T2, the CPU 28 determines that the outer diameter of the heating roller 2 increases due to thermal expansion and that the hardness of the heating roller 2 has changed.

As described above, while the embodiment has described an example of a method of controlling inductive heating by way of example of the coil 61*a*, the coil 62*a* is also controlled in the same manner as coil 61*a*, a predetermined high frequency current is supplied, an ON time is detected by the timer 28*a*, the detected time is stored in the ROM 28*b*, and then, the stored time is compared with a predetermined value.

In addition, in the embodiment, the elastic member 2*b* is composed of, for example, a silicon rubber or a foam rubber. The conductive layer 2*c* is composed of aluminum, nickel, iron or the like having thickness of about 0.5 mm to 2 mm. The primer layer 2*d* is compose of, for example, a silicon rubber having thickness of about several microns, and has a function of improving intimate contact strength between the conductive layer 2*c* and the molding release layer. The molding release later 2*e* is formed to have thickness of about 10 microns at the outermost periphery portion thereof, and is composed of a fluorine resin (PFA or PTFE (polytetrafluoride ethylene) or a mixture of PFA and PTTE).

Second Embodiment

Figure 7:
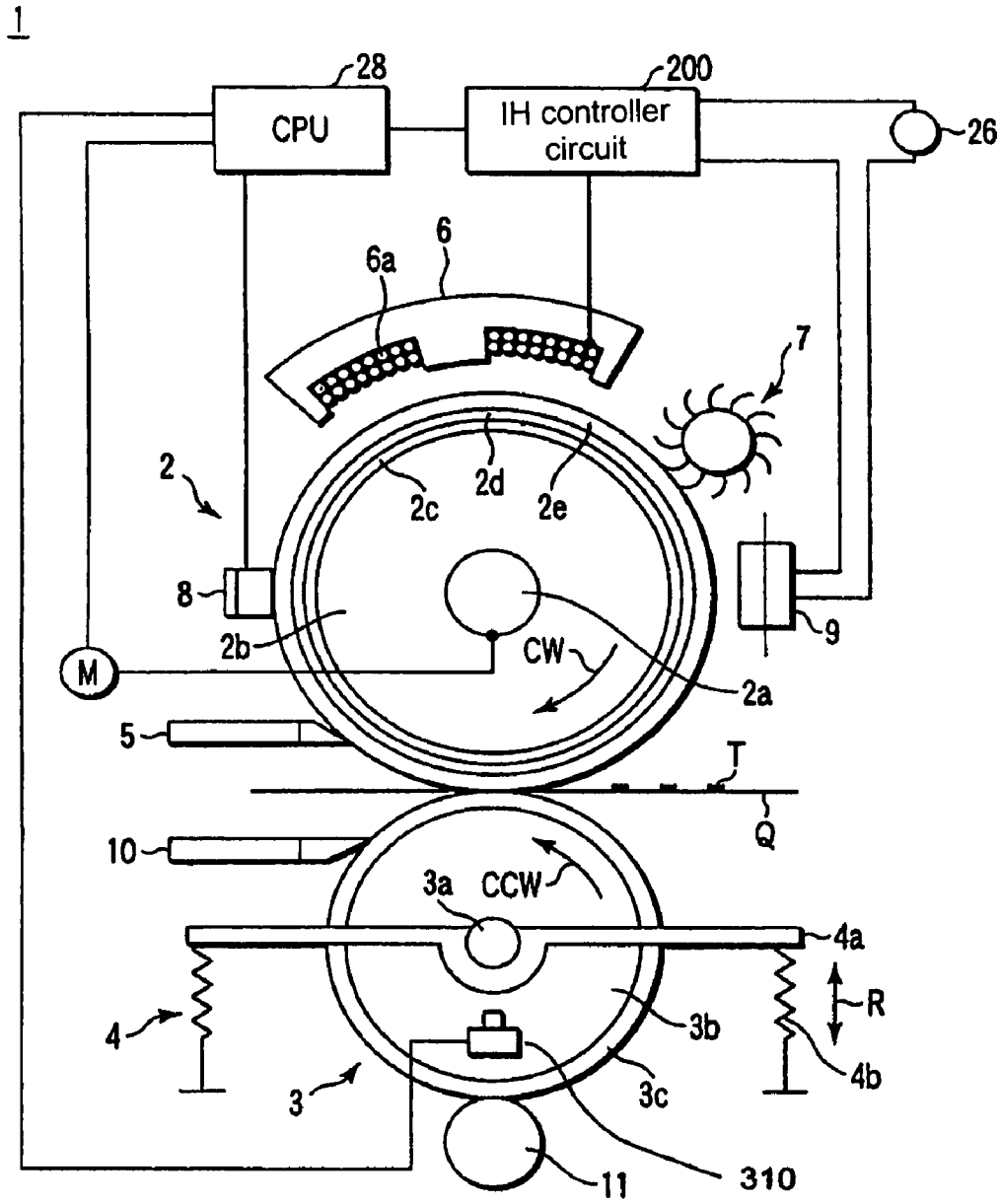
FIG. 7 is a schematic view showing another example of the fixing apparatus to be mounted on the image forming apparatus shown in FIG. 1.

Referring now to FIG. 7, a description will be given with respect to an example which is different from the fixing apparatus described with reference to FIG. 2.

FIG. 7 shows an example of a fixing apparatus according to a second embodiment of the invention. Like constituent elements shown in FIG. 2 are designated by like reference numerals. A detailed description or illustration of these constituent elements is omitted here.

As shown in FIG. 7, the fixing apparatus 1 has: the heating roller 2; the pressurizing roller 3; the inductive heating device 6 which heats the heating roller 2 by utilizing inductive heating; an IH controller circuit 200 which controls the inductive heating device 6; a CPU 28 connected to the IH controller circuit 200; and a micro-switch element 310 connected to the CPU 28, the micro-switch element 310 sensing a hardness change by thermal expansion of the heating roller 2 or the like.

The heating roller 2, for example, has: the shaft member 2*a* fixed to the fixing apparatus 1 via a bearing BR as shown in FIG. 3; the elastic member 2*b* allocated at the periphery of the shaft member 2*a*; the conductive layer 2*c*; the primer layer 2*d*; and the molding release layer 2*e*. The heating roller is rotated by the drive motor M in the clockwise (CW) direction indicated by the arrow. With rotation of the heating roller 2, the pressurizing roller 3 is rotated in the counterclockwise (CCW) direction indicated by the arrow.

The pressurizing mechanism (pressure applying mechanism) 4 presses the pressurizing roller 3 against the heating roller 2 by an expansion and contraction force of the pressurizing spring 4*b* via the bearing member 4*a* connected to the shaft member 3*a*. In this manner, at a contact portion (nip portion) between the heating roller 2 and the pressurizing roller 3, a predetermined width (nip width) is formed in a transport direction of paper P.

The bearing member 4*a* is supported by the pressurizing spring 4*b* so as to be movable in an R direction indicated by the arrow in response to expansion and contraction of the pressurizing spring 4*b*.

In the vicinity of the bearing member 4*a*, the micro-switch element (hardness change detecting mechanism) 310 is allocated at a predetermined position with which the bearing member 4*a* moved in a direction distant from the heating roller 4*b* comes into contact. The micro-switch element 310 is connected to the CPU 28 to output a signal indicating ON/OFF of the switching element.

When a signal indicating ON of the micro-switch element 310 is inputted, the CPU 28 determines that the micro-switch element 31 has been electrically conductive due to movement of the pressurizing roller 3. That is, the elastic member 2*b* thermally expands, whereby the hardness on the outer periphery face of the heating roller 2 increases, and it is determined that the pressure roller 3 has been pushed up toward the outward direction of the heating roller 2. In this manner, the micro-switch element 310 which is a hardness change detecting mechanism detects a hardness change of the heating roller 2. Then, the micro-switch element stops at least an operation of the IH controller circuit 200 which heats the heating roller 2. In the embodiment, operations of the fixing apparatus 1 and image forming apparatus 101 are stopped, and equipment stoppage (error) is displayed at a display section 104.

Then, inductive heating by the inductive heating device 6 is also stopped, and a temperature of the heating roller 2 also starts lowering. Thus, the outer peripheral face (outer diameter) of the heating roller 2 while in expanding and the hardness of the heating roller 2 return to a normal state. In this manner, the pressurizing roller 3 also returns to its original position as shown in FIG. 7, and the micro-switch element 310 also turns OFF. Upon the receipt of this phenomenon, the CPU 28 causes the display section 104 to display that an error due to a hardness change of the heating roller 2 has been recovered. When a user instructs operation restart, the fixing apparatus 1 is operated again.

Therefore, as shown in the embodiment, even in the case where the hardness of the elastic member 2*b* has changed in the heating roller 2 having the elastic member 2*b* inside of the conductive layer 2*c* which generates a heat due to inductive heating, a hardness change of the heating roller 2 is detected by the micro-switch element 310, and an inductive heating operation is stopped.

Accordingly, the hardness of the heating roller 2 is prevented from being excessively high. Thus, the hardness of the heating roller 2 is maintained at a predetermined or lower level, so that the heating roller 2 and the pressurizing roller 3 can ensure a predetermined range of nip width. Therefore, good image forming can be carried out.

In this manner, the micro-switch 310 (hardness change detecting mechanism) described in the embodiment is capable of sensing that a distance between the shaft member 2*a* of the heating roller 2 and the shaft member 3*a* of the pressurizing roller 3 has increased due to movement of the pressurizing roller 3, and detecting that the hardness of the heating roller 2 has changed due to thermal expansion of the elastic member 2*b*.

Third Embodiment

Figure 8:
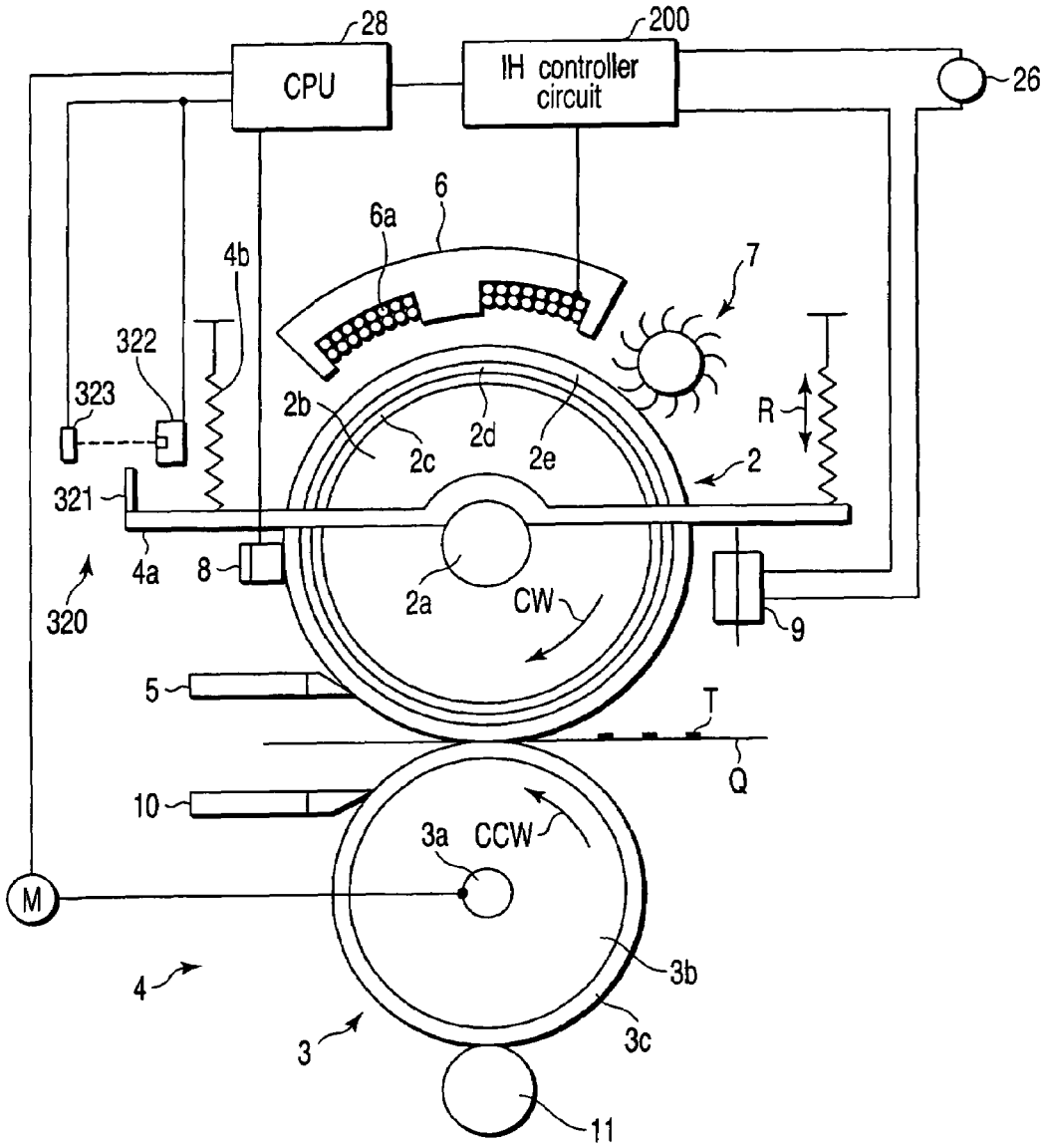
FIG. 8 is a schematic view showing another example of the fixing apparatus to be mounted on the image forming apparatus shown in FIG. 1.

Referring now to FIG. 8, a description will be given with respect to an example which is different from the fixing apparatus described with reference to FIG. 2.

FIG. 8 shows an example of a fixing apparatus according to a third embodiment of the invention. Like constituent elements shown in FIG. 2 are designated by like reference numerals. A detailed description or illustration of these constituent elements is omitted here.

As shown in FIG. 8, the pressurizing roller 3 is fixed to the fixing apparatus 1 via a bearing BR as shown in FIG. 3. On the other hand, the heating roller 2 is press-fitted to the pressurizing roller 3 by the pressurizing mechanism 4 via the bearing member 4*a*.

Then, the pressurizing roller 3 is rotated by the drive motor M in the counterclockwise (CCW) direction indicated by the arrow. With rotation of the pressurizing roller 3, the heating roller 2 is rotated in the CW direction indicated by the arrow.

In this manner, at a nip portion between the heating roller 2 and the pressurizing roller 3, a predetermined nip width is formed in a transport direction of the paper Q.

A hardness change detecting mechanism 320 has: a light shield member 321 provided at the bearing member 4*a*; a light emitting element 322 provided at a predetermined position of the fixing apparatus 1; and a light receiving element 323 which receives light from the light emitting element 322. The light emitting element 322 and the light receiving element 323 are connected to the CPU 28. The hardness change detecting mechanism 320 may utilize an optical reader element such as a photo-coupler.

The light receiving element 323 continuously receives light from the light emitting element 322 without the light being shielded by the light shield member 321, as shown in FIG. 8, in general.

However, if the hardness of the outer periphery face of the heating roller 2 increases due to thermal expansion, and the heating roller 2 moves, the light shield member 321 also moves together with the bearing member 4*a*. Then, by movement of the light shield member 321, the light from the light emitting element 322 is shielded for a predetermined time or longer in the light receiving element 323. In this manner, the CPU 28 is capable of detecting that the hardness of the heating roller 2 has changed.

The CPU 28 having thus detected a hardness change of the heating roller 2 stops at least an operation of the IH controller circuit 200 which heats the heating roller 2. In the embodiment, in the case where the light receiving element 323 is light-shielded for a predetermined time or longer, operations of the fixing apparatus 1 and image forming apparatus 101 are stopped, and equipment stoppage (error) is displayed at a display section 104.

Then, inductive heating by the inductive heating device 6 is also stopped, and the temperature of the heating roller 2 also starts lowering. Thus, the hardness of the heating roller 2 returns to a normal state. In this manner, the heating roller 2 also returns to its original position as shown in FIG. 8, and the light receiving section 323 also can continuously receive the light from the light emitting section 322. In this manner, the CPU 28 causes the display section 104 to display that an error due to a hardness change of the heating roller 2 has been recovered. When a user instructs operation restart, the fixing apparatus 1 is operated again.

Therefore, as shown in the embodiment, even in the case where hardness has changed due to thermal expansion, the heating roller 2 having the elastic member 2*b* inside of the conductive layer 2*c* which generates a heat due to inductive heating resists against the pressurizing roller 3 and moves in an opposite direction. Concurrently, the bearing member 4*b* also moves.

Accordingly, the hardness change detecting mechanism 320 detects a hardness change of the heating roller 2 in non-contact with the heating roller 2 and the pressurizing roller 3. Thus, the hardness of the heating roller 2 is prevented from being excessively high. Therefore, the hardness of the heating roller 2 is maintained at a predetermined or lower level, so that the heating roller 2 and the pressurizing roller 3 can ensure a predetermined range of nip width. Consequently, good image fixing can be carried out.

As has been described above, the hardness change detecting mechanism 320 described in the embodiment is capable of sensing that a distance between the shaft member 2*a* of the heating roller 2 and the shaft member 3*a* of the pressurizing roller 3 has increased due to movement of the heating roller 2 and detecting that the hardness of the heating roller 2 has changed due to thermal expansion.

Fourth Embodiment

Figure 9:
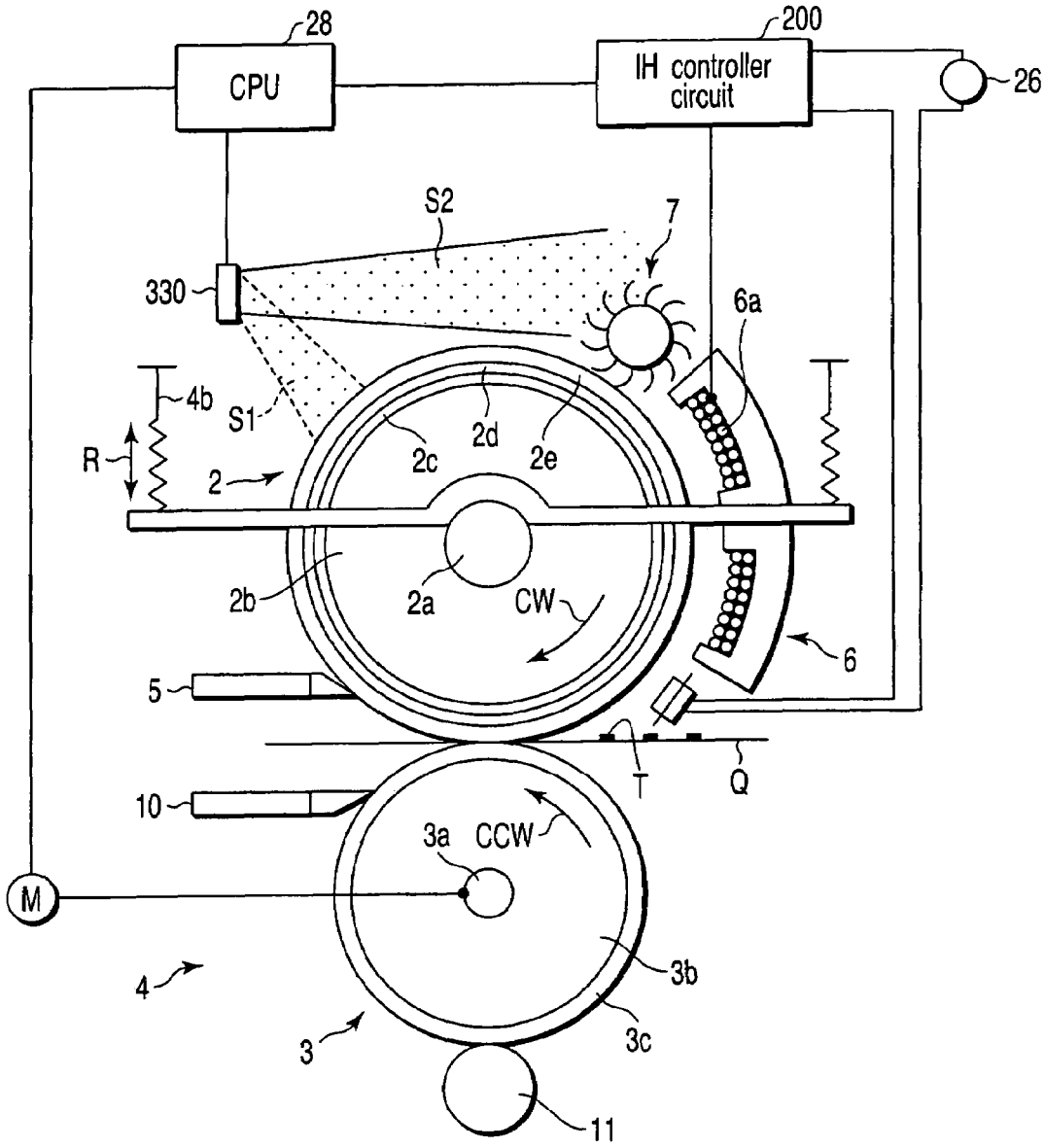
FIG. 9 is a schematic view showing another example of the fixing apparatus to be mounted on the image forming apparatus shown in FIG. 1.

Referring now to FIG. 9, a description will be given with respect to an example which is further different from the fixing apparatus described with reference to FIG. 2.

FIG. 9 shows an example of a fixing apparatus according to a fourth embodiment of the invention. Like constituent elements shown in FIG. 2 are designated by like reference numerals. A detailed description or illustration of these constituent elements is omitted here.

As shown in FIG. 9, the pressurizing roller 3 is fixed to the fixing apparatus 1 via a bearing BR as shown in FIG. 3.

On the other hand, the heating roller 2 is pressfitted against the pressurizing roller 3 by the pressurizing mechanism 4 via the bearing member 4*a*.

Then, the pressurizing roller 3 is rotated by the drive motor M in the counterclockwise (CCW) direction indicated by the arrow. With rotation of the pressurizing roller 3, the heating roller 2 is rotated in the clockwise (CW) direction indicated by the arrow.

In this manner, at a nip portion between the heating roller 2 and the pressurizing roller 3, a predetermined nip width is formed in a transport direction of the paper Q.

A CPU 28 is connected to the drive motor M which rotates the pressurizing roller 3 and a temperature detecting section 330 which detects the surface temperature of the heating roller 2 in a non-contact manner. The temperature detecting section 330 serves as a compound eye type sensor capable of sensing temperatures of a plurality of regions and measures a temperature of regions S1 and S2. The CPU 28 controls an IH controller circuit 200 such that the surface temperature of the heating roller 2 becomes constant on the basis of the temperature of the region S1 detected by the temperature detecting section 330.

In addition, the temperature detecting section (red infrared-ray temperature sensor) 330 observes a red infrared-ray in an observation region 2S. As shown in FIG. 9, in general, the detecting section measures an atmospheric temperature at the periphery of the heating roller 2 heated by the heating roller 2.

On the other hand, if the hardness of the outer periphery face of the heating roller 2 increases due to thermal expansion, the pressurizing roller 3 is fixed to the fixing apparatus, and thus, the heating roller 2 supported to be movable by the pressurizing mechanism 4 moves so as to be distant from the pressurizing roller 3. Therefore, the heating roller 2 approaches the observation region S2 of the temperature detecting section 330, or alternatively, the surface of the heating roller 2 enters the observation region S2. At this time, a temperature detected by the temperature detecting section 330 is much higher as compared with a normal state in which an atmospheric temperature heated by the heating roller 2 is being measured. Thus, the temperature detected by the temperature detecting section 330 rapidly rises.

Therefore, the CPU 28 can detect a hardness change of the heating roller 2 by sensing such a rapid rise of the temperature. Namely, the temperature detecting section 330 detects the temperature of the heating roller 2 and functions as a hardness change detecting mechanism capable of detecting a hardness change of the heating roller 2.

When the temperature detecting section 330 detects a rapid temperature rise, the CPU 28 outputs at least a signal for stopping an operation of the IH controller circuit 200 which heats the heating roller 2. In the embodiment, when the temperature detecting section 330 detects a rapid temperature rise, operations of the fixing apparatus 1 and image forming apparatus 101 are stopped, and equipment stoppage (error) is displayed on a display section 104.

Then, inductive heating by the inductive heating device 6 is also stopped, and thus, the temperature of the heating roller 2 also starts lowering. Thus, the hardness of the heating roller 2 returns to a normal state. Then, the CPU 28 causes the display section 104 to display that an error due to a hardness change of the heating roller 2 has been recovered. When a user instructs operation restart, the fixing apparatus 1 is operated again.

Therefore, as shown in the embodiment, even in the case where the hardness of the elastic member 2*b* has changed due to thermal expansion, the heating roller 2 having the elastic member 2*b* inside of the conductive layer 2*c* resists against the pressurizing roller 3 and moves in an opposite direction. In this manner, the temperature detecting section 330 which is measuring the surface temperature of the heating roller 2 detects a rapid temperature rise and detects a hardness change of the heating roller 2. That is, the hardness change detecting mechanism 330 detects a hardness change of the heating roller 2 in non-contact manner with the heating roller 2 and the pressurizing roller 3.

Accordingly, the hardness of the heating roller 2 is prevented from being excessively high. Thus, the hardness of the heating roller 2 is maintained at a predetermined or lower level, so that the heating roller 2 and the pressurizing roller 3 can ensure a predetermined range of nip width. Consequently, good image forming can be carried out.

In this manner, the micro-switch 330 (hardness change detecting mechanism) described in the embodiment is capable of sensing that a distance between the shaft member 2*a* of the heating roller 2 and the shaft member 3*a* of the pressurizing roller 3 has increased due to movement of the heating roller 2, and detecting that the hardness of the heating roller 2 has changed due to thermal expansion.

Fifth Embodiment

Figure 10:
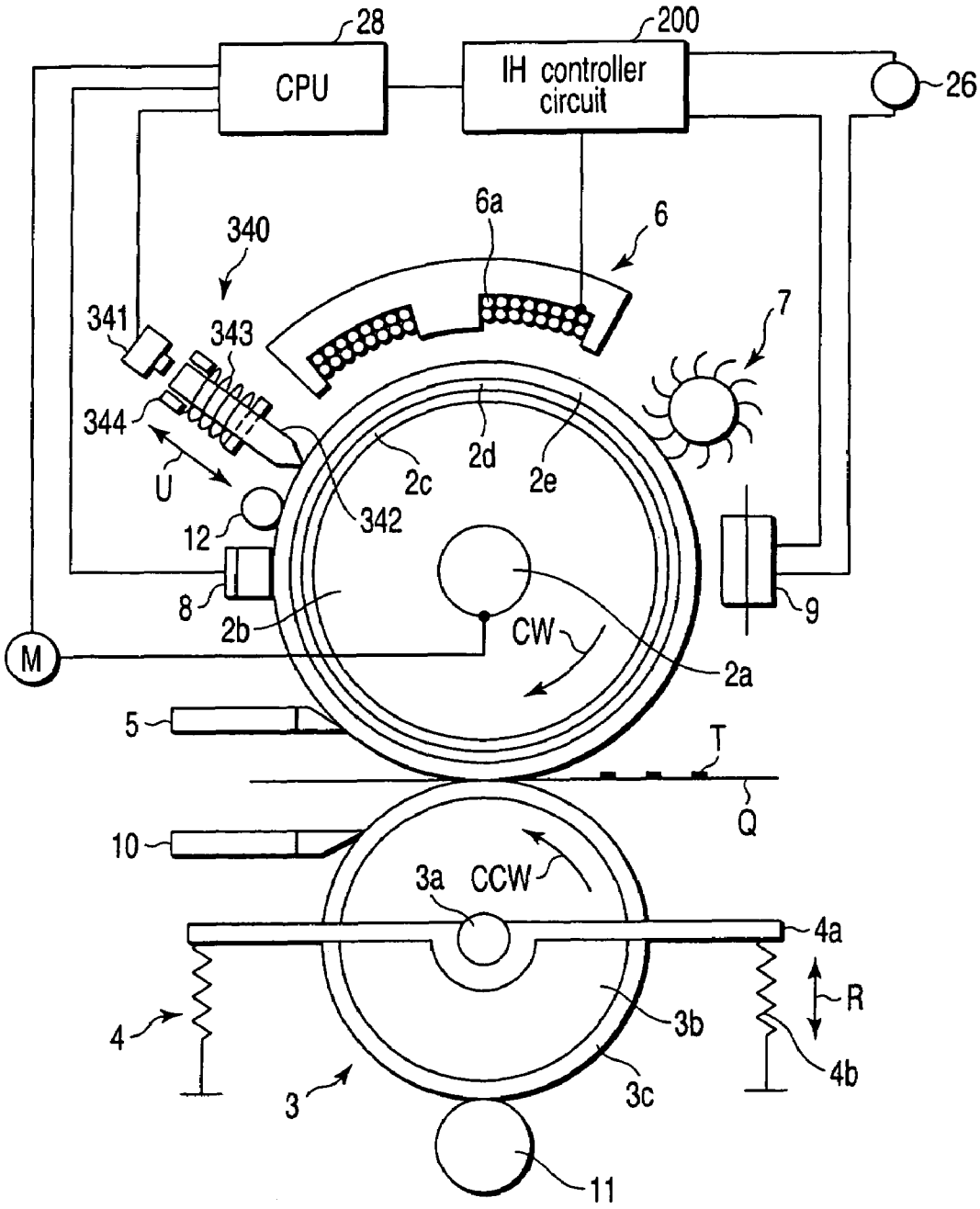
FIG. 10 is a schematic view showing another example of the fixing apparatus to be mounted on the image forming apparatus shown in FIG. 1.

Referring now to FIG. 10, a description will be given with respect to an example which is further different from the fixing apparatus described with reference to FIG. 2.

FIG. 10 shows an example of a fixing apparatus according to a fifth embodiment of the invention. Like constituent elements shown in FIG. 2 are designated by like reference numerals. A detailed description or illustration of these constituent elements is omitted here.

As shown in FIG. 10, the fixing apparatus according to the embodiment has: the heating roller 2 fixed at a predetermined position of the fixing apparatus via a bearing BR as shown in FIG. 3, for example; the pressurizing roller 3 supported to be movable by the pressurizing mechanism 4 to apply a pressure to the heating roller 2; and a hardness change detecting mechanism 340 which senses a hardness change of the outer periphery face of the heating roller 2 due to expansion.

The hardness change detecting mechanism 340 has: a micro-switch element (hardness change detecting section) 341 connected to a CPU 28; a movable section (pressure contact member) 342 allocated between the micro-switch 341 and the outer periphery face of the heating roller 2, a tip end of which comes into contact with the outer periphery face of the heating roller 2; and a holding member 344 fixed at a predetermined position of the fixing apparatus to support the pressure contact member 342 to be movable in a radial direction of the heating roller 2 (U direction indicated by the arrow) via an elastic member (for example, spring or rubber) 343.

A rear end of the pressure contact member 342 is, in general, allocated in a non-contact manner with the micro-switch element 341, as shown in FIG. 10.

However, when the hardness of the heating roller 2 changes due to thermal expansion, the pressure member 342 is pushed up at an opposite side along the radial direction from the heating roller 2. The rear end of the pushed-up pressure contact member 342 comes into contact with the micro-switch 341, and a switch is turned ON. Then, the CPU 28 having received an ON signal from the micro-switch 341 detects that the hardness of the heating roller 2 has changed.

The CPU 28 having thus detected a hardness change of the heating roller 2 stops at least an operation of an IH control circuit 200 which heats the heating roller 2. In the embodiment, operations of the fixing apparatus 1 and image forming apparatus 101, and then, equipment stoppage (error) is displayed at a display section 104.

Then, inductive heating by the inductive heating device 6 is also stopped, and the temperature of the heating roller 2 also starts lowering. Thus, the hardness of the heating roller 2 also returns to a normal state. In this manner, the pressurizing roller 3 also returns to its original position as shown in FIG. 10, and the micro-switch element 341 also turns OFF. Upon the receipt of this phenomenon, the CPU 28 causes the display section 104 to display that an error due to a hardness change of the heating roller 2 has been recovered. When a user instructs operation restart, the fixing apparatus 1 is operated again.

Therefore, as shown in the embodiment, even in the case where the hardness has changed due to thermal expansion in the heating roller 2 having an elastic member 2*b* inside of the conductive layer 2*c* which generates a heat due to inductive heating, such a hardness change of the hating roller 2 is detected by detecting expansion on the outer periphery face of the heating roller 2.

Accordingly, the hardness of the heating roller 2 is prevented from being excessively high. Thus, the hardness of the heating roller 2 is maintained at a predetermined or lower level, so that the heating roller 2 and the pressurizing roller 3 can ensure a predetermined range of nip width. Consequently, good image fixing can be carried out.

The pressure contact member 342, at an end portion of the heating roller 2, is press-fitted against a non-paper passing region defined as a region in which the paper Q does not passes. Thus, no image failure occurs due to degradation of the surface of the heating roller 2.

Further, while the embodiment has described an example of using the pressure contact member 342 as a hardness change detecting mechanism as described above, the present invention is not limited thereto, and may use, for example, the releasing blade 5, the cleaning member 7, the thermister 8, and the oil coating member 12 allocated at the periphery of the heating roller 2.

That is, at least one of the releasing blade 5, the cleaning member 7, the thermister 8, the oil coating member 12 and the like arbitrarily selected as the pressure contact member of the hardness change detecting mechanism 340 is allocated to be movable in the radial direction of the heating roller 2, and then, the micro-switch element 341 is allocated in a direction distant from the axial center of the heating roller 2. If the outer diameter of the heating roller 2 changes due to thermal expansion, at least selected one of the releasing blade 5, the cleaning member 7, the thermister 8, the oil coating member 12 and the like may become conductive in contact with the microswitch element 341.

In addition, while the embodiment has described the hardness change detecting mechanism 340 by way of example of utilizing the micro-switch element 341, the present invention is not limited thereto, and may use, for example, a light emitting element, a light receiving element, and a light shield member, as shown in FIG. 8.

That is, a light receiving element and a light emitting element may be provided instead of the microswitch element 341, wherein, as shown in FIG. 6, a rear end of the pressure contact member 342 held to be movable in a U direction indicated by the arrow shields the light from the light emitting element in pressure contact with the heating roller 2, and in the case where the light receiving element has been lightshielded for a predetermined time or longer, a hardness change of the heating roller is detected.

Further, while the embodiment has described the hardness change detecting mechanism 340 by using as a movable section the pressure contact member 342 brought into pressure contact with the surface of the heating roller 2, the present invention is not limited thereto, and may be configured, for example, such that the detecting mechanism may be provided in a non-contact manner without being brought into pressure contact with the surface of the heating roller 2.

That is, as another example of the hardness change detecting mechanism 34, although not shown, a gap has been provided between the movable section 342 and the surface of the heating roller 2, and if the outer periphery face of the heating roller 2 expands due to thermal expansion, the movable section 342 is moved in a radial direction. Then, a construction may be provided so as to detect a hardness change of the heating roller 2 by using a micro-switch element which detects movement of the movable section 342, or alternatively, a detecting mechanism which includes a light emitting element and a light receiving section. Therefore, as has been described above, even in the case where the releasing blade 5, the cleaning member 7, the thermister 8, the oil coating member 12 and the like are utilized as movable sections, or alternatively, even in the case where the releasing blade, the cleaning member, the thermister, the oil coating member and the like are provided in a non-contact manner, each of these elements can be utilized as the movable section 342.

As has been described above, according to the present invention, even in the case where a heating roller comprising a thin film conductive layer and an elastic member which has a thermal conductivity different from the conductive layer inside of the roller is heated by utilizing inductive heating capable of speedily increasing the surface temperature of the heating roller up to a set temperature, a hardness change of the heating roller can be detected by thermal expansion, and an operation of the fixing apparatus can be stopped. If the temperature of the heating roller has been lowered, and the hardness is also lowered, the fixing apparatus heats the heating roller again and fixes a developer onto paper. Thus, when the hardness of the heating roller has changed, a fixing operation is stopped. Therefore, a predetermined or greater nip width can be ensured, and good image forming can be carried out.

The present invention is not limited to the above-described embodiments. The invention can be embodied by modifying constituent elements without departing from the spirit at the stage of carrying out the invention. In addition, a variety of inventions can be formed by using a proper combination of a plurality of constituent elements disclosed in the above-described embodiments. For example, some of all the constituent elements shown in the embodiments may be erased. Further, the constituent elements over the different embodiments may be properly combined with each other.

For example, FIG. 2 has described an example of using the micro-switch element 310 as a hardness change detecting mechanism, but not limited thereto. The invention may include a light emitting element, a light receiving element, and a light shield member, as described with reference to FIG. 8, for example, and may provide a construction of detecting a hardness change of the heating roller 2 due to movement of the pressurizing roller 3.

In addition, while FIG. 8 has described an example of using a hardness change detecting mechanism 320 which includes a light emitting element 322, a light receiving element 323, and a light shield member 321 as a hard change detecting mechanism, the present invention is not limited thereto and may provide a construction comprising a micro-switch element which becomes electrically conductive by the bearing member 4*a* coming into contact with the element, as described with reference to FIG. 7, for example.

Further, the CPU 28 shown in FIGS. 5 and 7 to 10 may be a control mechanism which controls an operation of the fixing apparatus 1, may be a control mechanism which controls an operation of the image forming apparatus 101 shown in FIG. 1, or alternatively, may be a control mechanism which controls an operation of the image forming section 103.

The elastic member 2*b* included in the heating roller 2 shown in FIGS. 2 and 7 to 10 may be provided as a constituent element such that an outer diameter of a center portion thereof in an axial direction is smaller than that of an end portion thereof, or may be provided as a constituent element having a predetermined outer diameter.

Further, the heating roller 2 may be provided as, for example, a constituent element including a through hole or the like for releasing to the outside an atmosphere in which the inside temperature of the heating roller 2 rises, and the roller thermally expands, without being limited to the constituent element including the elastic member 2*b* as described with reference to FIG. 4.

Moreover, as described with reference to FIGS. 5 and 6 in the first embodiment, the invention includes the hardness change detecting mechanism capable of sensing a change in electrical characteristics of the coil 61 or the coil 62*a* based on the ON time T1 measured by the timer 28*a* and detecting that the hardness of the heating roller 2 has changed due to thermal expansion. However, the invention is not limited thereto, and for example, may detect a change in electrical characteristics of the coil 61*a* or the coil 62*a* by comparing a frequency of a current flowing through the coil 61*a* or the coil 62*a* with a drive frequency instructed to the driver circuits 31, 32. This is because a current at a frequency at which a total of ON time and OFF time (t1 to t5) of the switching element 23 or 24 shown in FIG. 6 is defined as one cycle flows through the coils 61*a* or the coil 62*a*.

What is claimed is:

1. An image forming apparatus, comprising:

an image carrier which holds a developer image in an electrostatic manner; and a fixing apparatus which melts and fixes the developer image onto a recording medium to which the developing material image has been transferred, the fixing apparatus comprising:

a first roller member fixed at a predetermined position and rotated by a drive mechanism;

a second roller member having a shaft member, the second roller member being press-fitted against the first roller member by a pressure applying mechanism via a bearing member connected to the shaft member;

an elastic layer formed at least at one of the first roller member and the second roller member;

a conductive layer formed outside of the elastic layer;

an inductive heating device including a coil, the inductive heating device supplying inductive heating to the conductive layer by a magnetic field generated from the coil, thereby heating the conductive layer; and a hardness change detecting mechanism which senses movement of the pressure applying mechanism in a non-contact manner with the pressure applying mechanism to detect expansion of an outer periphery face of the first roller member or the second roller member due to thermal expansion caused by the inductive heating, the hardness change detecting mechanism including:

a light emitting element;

a light receiving element which receives light from the light emitting element; and a light shield member provided at the bearing member, and due to the movement of the pressure applying mechanism, the light from the light emitting element to the light receiving element is shielded by the light shield member, thereby detecting a hardness change of the first roller member or the second roller member.

2. An image forming apparatus according to claim 1, further comprising:

a control section which, when the hardness change detecting mechanism detects a hardness change, temporarily stops an operation of the fixing apparatus; and a display section which displays that the operation of the fixing apparatus has been stopped by the control section.

3. A fixing apparatus, comprising:

a first roller member fixed at a predetermined position and rotated by a drive mechanism;

a second roller member having a shaft member, the second roller member being press-fitted against the first roller member by a pressure applying mechanism via a bearing member connected to the shaft member;

an elastic layer formed at least at one of the first roller member and the second roller member;

a conductive layer formed outside of the elastic layer;

an inductive heating device including a coil, the inductive heating device supplying inductive heating to the conductive layer by a magnetic field generated from the coil, thereby heating the conductive layer; and a hardness change detecting mechanism which senses movement of the pressure applying mechanism in a non-contact manner with the pressure applying mechanism to detect expansion of an outer periphery face of the first roller member or the second roller member due to thermal expansion caused by the inductive heating, the hardness change detecting mechanism including:

a light emitting element;

a light receiving element which receives light from the light emitting element; and a light shield member provided at the bearing member, and due to the movement of the pressure applying mechanism, the light from the light emitting element to the light receiving element is shielded by the light shield member, thereby detecting a hardness change of the first roller member or the second roller member.

4. A fixing apparatus according to claim 3, further comprising:

a control section which, when the hardness change detecting mechanism detects a hardness change, temporarily stops an operation of the fixing apparatus; and a display section which displays that the operation of the fixing apparatus has been stopped by the control section.

* * * * *